US010052684B2

(12) United States Patent
Lang et al.

(10) Patent No.: US 10,052,684 B2
(45) Date of Patent: Aug. 21, 2018

(54) MONITORING METHOD FOR A CONTINUOUS CASTING MOULD INCLUDING BUILDING UP A DATABASE

(71) Applicant: PRIMETALS TECHNOLOGIES AUSTRIA GMBH, Linz (AT)

(72) Inventors: Oliver Lang, Dietach (AT); Christian Ortner, Linz (AT); Martin Schuster, Kopfing (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 240 days.

(21) Appl. No.: 14/651,752

(22) PCT Filed: Oct. 29, 2013

(86) PCT No.: PCT/EP2013/072544
§ 371 (c)(1),
(2) Date: Jun. 12, 2015

(87) PCT Pub. No.: WO2014/095137
PCT Pub. Date: Jun. 26, 2014

(65) Prior Publication Data

US 2015/0314368 A1 Nov. 5, 2015

(30) Foreign Application Priority Data

Dec. 21, 2012 (DE) ..... 10 2012 224 132

(51) Int. Cl.
*B22D 11/16* (2006.01)
*B22D 11/114* (2006.01)
*B22D 11/12* (2006.01)

(52) U.S. Cl.
CPC ..... *B22D 11/16* (2013.01); *B22D 11/114* (2013.01); *B22D 11/122* (2013.01); *B22D 11/165* (2013.01); *B22D 11/166* (2013.01)

(58) Field of Classification Search
CPC ... B22D 11/165; B22D 11/166; B22D 11/114; B22D 11/16; B22D 11/22
See application file for complete search history.

(56) References Cited

U.S. PATENT DOCUMENTS 5,931,215 A 8/1999 Wochnik ..... 164/452
2008/0035298 A1* 2/2008 Yu ..... B22D 11/22 164/455

FOREIGN PATENT DOCUMENTS

CN 1182382 A 5/1998
CN 101045255 A 10/2007
(Continued)

OTHER PUBLICATIONS

Chinese Office Action, dated Jan. 5, 2016, issued in corresponding Chinese Patent Application No. 201380067064.7. English translation. Total 18 pages.
(Continued)

*Primary Examiner* — Kevin P Kerns
*Assistant Examiner* — Steven S Ha
(74) *Attorney, Agent, or Firm* — Ostrolenk Faber LLP

(57) ABSTRACT

A monitoring device (6) records variables that are characteristic of operating parameters of a continuous casting mold (1) for casting a metal strand (2). The monitoring device (6) records at least some of the characteristic variables by independently performing measurements during the casting of the metal strand (2). The monitoring device (6) forms groups (G1, G2) of operating parameters and independently tests whether the operating parameters of the respective group (G1, G2) satisfy a respective predetermined stability criterion. The monitoring device (6) accepts the operating parameters into a database (12). The monitoring device (6) determines those data records (11) contained in the database (12) that coincide in their input variables with the basic operating parameters and determines admissible operating
(Continued)

parameter ranges for supplementary operating parameters. The monitoring device (6) independently tests whether the supplementary operating parameters lie within the admissible operating parameter ranges.

12 Claims, 5 Drawing Sheets

(56) References Cited

FOREIGN PATENT DOCUMENTS

| | | | |
|---|---|---|---|
| CN | 101879583 | A | 11/2010 |
| CN | 102319883 | A | 1/2012 |
| DE | 2 320 277 | A1 | 11/1974 |
| DE | 197 22 877 | A1 | 12/1998 |
| DE | 198 10 672 | A1 | 9/1999 |
| DE | 101 19 354 | A1 | 10/2002 |
| EP | 1 103 322 | A1 | 5/2001 |
| WO | WO 02/085555 | A2 | 10/2002 |

OTHER PUBLICATIONS

International Search Report dated Feb. 25, 2014 issued in corresponding International patent application No. PCT/EP2013/072544.
Written Opinion dated Feb. 25, 2014 issued in corresponding International patent application No. PCT/EP2013/072544.
German Search Report dated Jul. 19, 2012 issued in corresponding German patent application No. 10 2012 224 132.9.

* cited by examiner

MONITORING METHOD FOR A CONTINUOUS CASTING MOULD INCLUDING BUILDING UP A DATABASE

CROSS-REFERENCE TO RELATED APPLICATIONS

The present application is a 35 U.S.C. §§ 371 national phase conversion of PCT/EP2013/072544, filed Oct. 29, 2013, which claims priority of German Patent Application No. 10 2012 224 132.9, filed Dec. 21, 2012, the contents of which are incorporated by reference herein. The PCT International Application was published in the German language.

TECHNICAL BACKGROUND

The present invention relates to a method of monitoring for a continuous casting mold for casting a metal strand, wherein monitoring equipment detects quantities, wherein the monitoring equipment automatically detects metrologically at least some of the quantities during the casting of the metal strand wherein the monitoring equipment uses the quantities detected to determine operating parameters of the continuous casting mold.

A monitoring method of this type is known, for example in the form of SIMETALL MOLD EXPERT from Siemens VAI Metals Technologies GmbH, Linz, Austria. In the case of monitoring methods of this type, all the relevant signals around about the continuous casting mold are detected and presented visually. In addition, by reference to the detected signals, predictive quantities are determined for the casting process, and are output to an operator of the continuous casting facility. For example, the entry temperature and exit temperature of a liquid coolant (generally water) and the corresponding coolant volume flows are used to determine the heat flows associated with the sidewalls of the continuous casting mold. Also, by reference to operating parameters of a vibration mechanism, by means of which the continuous casting mold is vibrated, a friction parameter is determined for the friction arising between the metal strand and the continuous casting mold. There is no categorization of the values determined into permissible or impermissible, or into good or bad, and the like.

The estimation of the measured and derived quantities is of importance for the casting process. In particular, a decision can be made on the basis of the measured and derived quantities as to whether the casting process is proceeding in an orderly manner, or whether control interventions are required.

Over time, experienced operators note, in particular, the values for the heat flow and friction which have arisen. Eventually they know the values for which the casting process has proceeded in an orderly manner, and the values for which the casting process experienced problems. However, this approach is only applicable to a restricted extent if the metal strand being cast has a new chemical composition—for example a new type of steel—if a different casting powder is being used or if over a period of time a large number of metal strands are cast which differ in their chemical composition.

In the prior art, it is known how to analyze the cast strand by means of metallurgical procedures, and from this to derive permissible values for particular chemical compositions of the metal strand. However, this approach is exceptionally time-consuming, and apart from that is liable to error.

DE 2 320 277 A1 discloses a method for monitoring the skin thickness of a strand which is being cast. In the context of this method, the heat flows in overlapping cooling zones are detected—separately for the individual sidewalls of the mold. From these detected heat flows, a characteristic quantity is determined and displayed and/or used directly for controlling the casting process.

DE 198 10 672 A1 discloses a method for monitoring the two-dimensional temperature profile of a continuous casting mold. Temperatures and heat flows are detected. The two-dimensional temperature profile is determined as a function of the detected temperatures and heat flows. The heat flows are adjusted in order to set a desired temperature profile.

DE 197 22 877 A1 discloses a method for measuring and regulating the temperature and quantity of the cooling water which cools the sidewalls of a continuous casting mold. The temperature of the cooling water is measured at several places in the region of the outflow openings in the copper plate and in the associated water tank. The measurement of this temperature profile, which of itself is one-dimensional, is repeated from time to time, so that the one-dimensional profile is developed into a two-dimensional profile. This two-dimensional temperature profile is displayed to an operator, so that the operator can, if necessary, make control interventions.

EP 1 103 322 A1 discloses a method for monitoring a continuous casting mold, by which the local temperatures and/or heat flow densities are detected, and from them the temperature loading on the mold wall is determined.

WO 02/085 555 A2 discloses a method of operation for a continuous casting mold, by which the speed of flow of cooling water is set in a controlled way, whereby the water flow is in the direction from below to above, unlike the method which is otherwise common.

SUMMARY OF THE INVENTION

It is the object of the present invention to provide the operator with a tool which makes it possible, in a simple way, to categorize the values determined into permissible or impermissible, or into good or bad, and the like.

In the invention, a monitoring method of the type cited in the introduction is so structured that the monitoring equipment forms groups of operating parameters, each of which includes at least one basic operating parameter and at least one supplementary operating parameter, the monitoring equipment automatically copies the operating parameters for the group concerned into a database as a data record, if the operating parameters of the group concerned satisfy a relevant first predefined stability criterion over a relevant evaluation time period, the monitoring equipment assigns to the data record the basic operating parameters as input quantities, and the supplementary operating parameters as output quantities, the monitoring equipment determines for which of the data records which are held in the database the input quantities match the basic operating parameters, and using these data the monitoring equipment determines for which of the data records which are held in the database the input quantities match the basic operating parameters, and using these data records determines permissible operating parameter ranges for the supplementary operating parameters, in the context of a second check, the monitoring equipment automatically checks whether the operating parameters lie within the permissible operating parameter ranges, and depending on the result of the second check, the monitoring equipment initiates further measures.

This approach achieves the effect that little by little the monitoring equipment fills up the database fully automatically with orderly data records, and in addition draws on those data records which are already present in the database in assessing the current operating parameters.

The groups of operating parameters can be chosen as required. As alternatives, they may include only some of the operating parameters, or all the operating parameters. Within the group concerned, the evaluation period is specific to the operating parameter concerned. It can be the same for all the operating parameters in the group concerned. Alternatively, it can be defined individually for the operating parameter concerned. The first stability criterion can also be the same for all the operating parameters in the group concerned, or can be chosen individually for each operating parameter.

The continuous casting mold is cooled by means of a volume flow of a liquid coolant—generally water. When it enters the continuous casting mold, the liquid coolant has an entry temperature, and on emerging from the continuous casting mold an exit temperature. The quantities which are metrologically detected during the casting of the metal strand will preferably include the volume flow, the entry temperature and the exit temperature and the operating parameters include a heat flow determined from the volume flow, the entry temperature and the exit temperature.

The continuous casting mold has a number of sidewalls. It is possible that the continuous casting mold has a single sidewall. This is the case, for example, for a pipe mold. Alternatively, the continuous casting mold can have several sidewalls. This is the case, for example, for a slab mold. Regardless of the number of sidewalls the volume flow, the entry temperature and the exit temperature are detected separately for each of the sidewalls, and the monitoring equipment determines the heat flow separately for each of the sidewalls.

In general, the heat flow tracks any change in the operating parameters relatively rapidly. Preferably, one of the predefined groups of operating parameters will include as a supplementary operating parameter the heat flow, and as basic operating parameters those operating parameters which are relevant for the heat flow.

When casting metal continuously, it is usual to vibrate the continuous casting mold during the continuous casting by means of a vibration mechanism, with a vibration frequency and a vibration amplitude. Preferably the quantities which are metrologically detected during the casting of the metal strand include the vibration frequency, vibration amplitude and the displacement forces necessary for vibrating the continuous casting mold, and the operating parameters include a friction parameter, determined from the vibration frequency, the vibration amplitude and the displacement forces, for friction arising between the metal strand and the continuous casting mold.

Preferably, one of the predefined groups of operating parameters will include as a supplementary operating parameter the friction parameter, and as basic operating parameters the operating parameters which are relevant to the friction parameter.

The basic operating parameters can be determined as required. For example, the basic operating parameters could include the material in the metal strand (for example steel, or aluminum, plus a definition of the alloying elements and their concentration), the format (for example, width and thickness) of the metal strand, a casting powder used in the casting of the metal strand, a casting speed and/or a level of the surface of the cast material.

It is possible that the data records copied into the database are exclusively those based on the characteristic quantities detected by the monitoring equipment itself in the operation of the continuous casting mold. Alternatively, it is possible that in addition to the quantities which it has detected, the monitoring equipment accepts, via a data input, temporal sequences of quantities, that the monitoring equipment also forms, by reference to quantities it has accepted via the data input, groups of operating parameters, each of which includes at least one basic operating parameter and at least one supplementary operating parameter, that, if the operating parameters for the groups formed by reference to the quantities accepted through the data input satisfy a relevant predefined first stability criterion over a relevant evaluation time period, the monitoring equipment copies into the database, as data records, those operating parameters which it has determined by reference to the quantities it accepted through the data input that the monitoring equipment assigns to the data record as the input quantities the basic operating parameters and as the output quantities the supplementary operating parameters.

This approach is of advantage particularly when the execution of the inventive monitoring method is starting up, for example if the data base does not (yet) have any data records when the execution of the inventive monitoring method is starting up. However, it can also be realized during ongoing operations, or afterwards.

It is possible that the monitoring equipment determines the permissible ranges for the operating parameters even if there are only a few data records stored in the database. However, the monitoring equipment will preferably determine the permissible operating parameter ranges for the supplementary operating parameters if, and only if, the data records for which the input quantities match the basic operating parameters satisfy a completeness criterion. The completeness criterion can, in particular, be satisfied if the database contains a sufficient number of data records for which the input quantities match the basic operating parameters. Alternatively, or additionally, the completeness criterion can be satisfied if the supplementary operating parameters, for those data records for which the input quantities match the basic operating parameters, satisfy a relevant predefined statistical second stability criterion.

If the operating parameters of the group concerned satisfy the relevant predefined first stability criterion over the evaluation period concerned, the operation of the continuous casting mold as such is uncritical. It can however happen that in spite of uncritical operation as such, the metal strand which is cast does not satisfy quality requirements, for example has cracks or too strong vibration marks. Preferably, the monitoring equipment will therefore suppress the copying of the data records into the database if an operator of the continuous casting mold issues a blocking command to it. Alternatively, if the operator issues a negative assessment of the data record, the monitoring equipment removes from the database data records which have already been copied into the database.

If the operating parameters of the group concerned satisfy the relevant predefined first stability criterion over the evaluation period concerned, the operation of the continuous casting mold as such is uncritical. It can however happen that in spite of uncritical operation as such, the metal strand which is cast does not satisfy quality requirements, for example has cracks or too strong vibration marks. Preferably, the monitoring equipment will therefore suppress the copying of the data records into the database if an operator of the continuous casting mold issues a blocking command to it. Alternatively, if the operator issues a negative assessment of the data record, the monitoring equipment removes from the database data records which have already been copied into the database.

If the operating parameters of the group concerned satisfy the relevant predefined first stability criterion over the evaluation period concerned, the operating parameters—in particular for example their weighted or unweighted mean values—can be copied into the database as data records. The first check, and the copying of a data record into the database which is based on it, will in this case be effected cyclically at regular time intervals. It is possible that the time interval is identical with the evaluation period for the at least one supplementary operating parameter in the group concerned. Preferably however, the time interval will be substantially shorter. For example, the time interval can lie (somewhere) between 0.1 s and several minutes.

The object is further achieved by a computer program which incorporates machine code which can be directly executed by monitoring equipment for a continuous casting mold, and the execution of which by the monitoring equipment has the effect that the monitoring equipment carries out a monitoring method with all the steps of a monitoring method in accordance with the invention.

The object is further achieved by monitoring equipment for a continuous casting mold where the monitoring equipment is constructed in such a way that it carries out a monitoring method with all the steps of a monitoring method in accordance with the invention.

The object is further achieved by a continuous casting mold for casting a metal strand, whereby monitoring equipment in accordance with the invention is assigned to the continuous casting mold.

The characteristics, features and advantages of this invention described above, together with the manner and way in which these are achieved, will become clearer and more comprehensible in conjunction with the following description of the exemplary embodiments, which are explained in more detail in conjunction with the drawings. These show, as schematic views:

DESCRIPTION OF EMBODIMENTS

Figure 1:
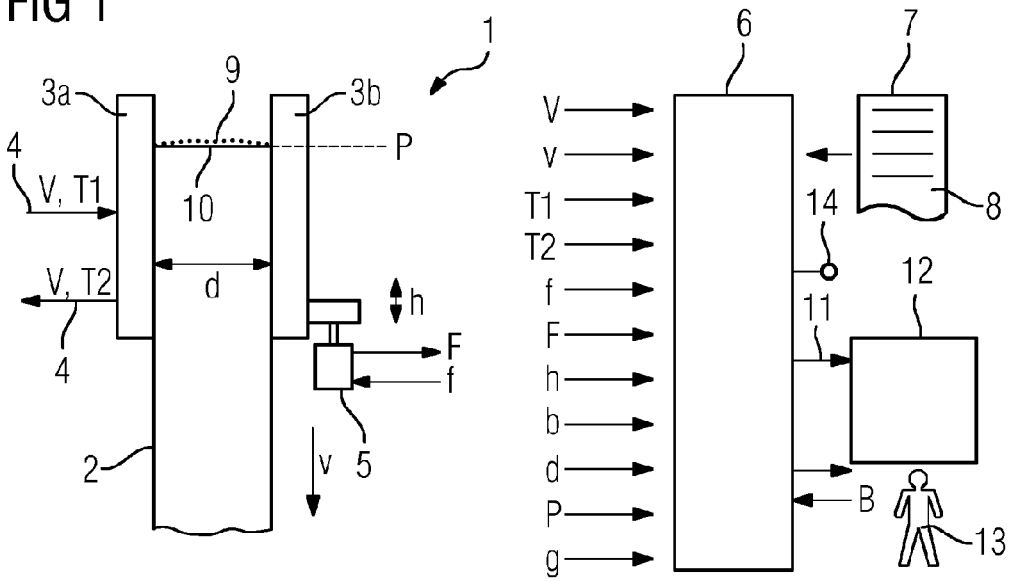
FIG. 1 shows a continuous casting mold from the side
Figure 2:
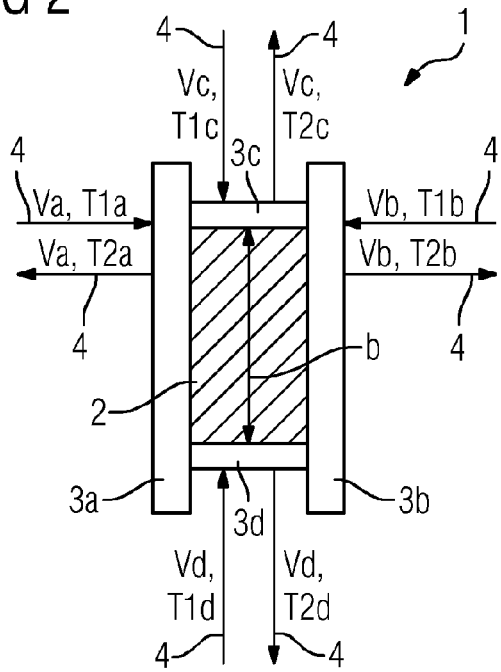
FIG. 2 shows the continuous casting mold from above.

As shown in FIGS. 1 and 2, a metal strand 2 is cast using a continuous casting mold 1. The metal strand 2 can, in particular, consist of steel. The metal strand 2 can, as shown in the illustrations in FIGS. 1 and 2, be strip-shaped in form. In this case, the continuous casting mold 1 has several sidewalls 3*a* to 3*d*. Furthermore, in the case of a strip-shaped metal strand 2, two of the sidewalls 3*a* to 3*d* are each constructed as wide sides 3*a*, 3*b* and two each as narrow sides 3*c*, 3*d*. The distances from each other of the sidewalls, 3*a* to 3*d*, which lie opposite each other define the format of the metal strand 2 which is cast, in particular its thickness d and its width b. Alternatively however, other formats can also be cast, in particular rod cross-sections. In this case, the continuous casting mold 1 has only a single sidewall.

The continuous casting mold 1 is cooled by means of a liquid coolant 4—generally water. Per unit of time (for example, per second), a volume flow V of the liquid coolant 4 flows through the continuous casting mold 1. When it enters the continuous casting mold 1, the liquid coolant 4 has an entry temperature T1 and on emerging from the continuous casting mold 1 an exit temperature T2. As shown in FIG. 2, the sidewalls 3*a* to 3*d* have in each case a separate volume flow, Va to Vb, of the coolant 4 flowing through it, where each of the volume flows Va to Vb has its own entry temperature T1*a* to T1*d* when it enters the sidewall concerned of the continuous casting mold 1 and on exiting from the continuous casting mold 1 its own exit temperature T2*a* to T2*d*.

As shown in FIG. 1A, there is assigned to the continuous casting mold 1 a vibration mechanism 5, for example a hydraulic cylinder unit. By means of the vibration mechanism 5, the continuous casting mold 1 is vibrated during the casting of the strand, with a vibration frequency f and a vibration amplitude h. For the purpose of vibrating the continuous casting mold 1, displacement forces F are required.

As shown in FIG. 1B, the continuous casting mold 1 has monitoring equipment 6 assigned to it. The monitoring equipment 6 is generally structured as software programmable equipment. The way in which the monitoring equipment 6 functions is thus defined by a computer program 7, with which the monitoring equipment 6 is programmed. By its programming with the computer program 7, the monitoring equipment 6 is appropriately structured.

The computer program 7 incorporates machine code 8. This machine code 8 is directly executable by the monitoring equipment 6. The execution of the machine code 8 by the monitoring equipment 6 causes the monitoring equipment 6 to execute a monitoring method, which is explained in more detail below by reference to FIG. 3.

Figure 3:
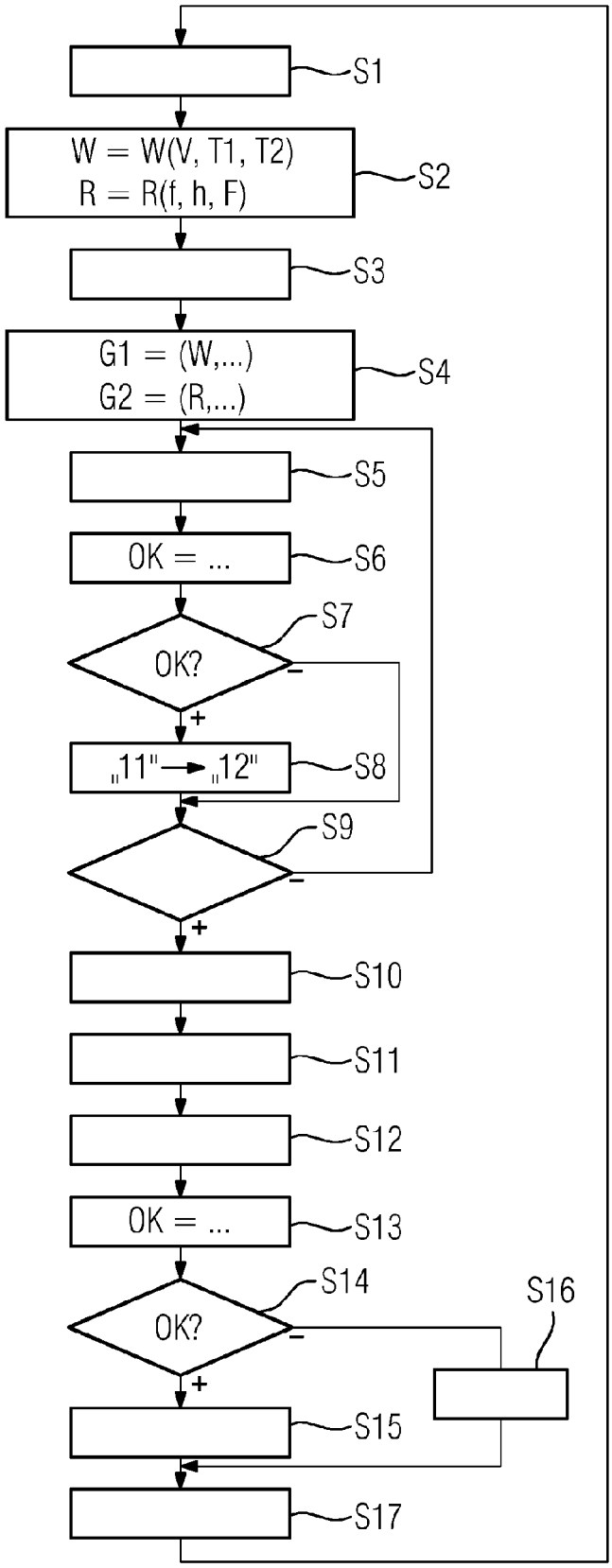
FIG. 3 shows a flow diagram.

As shown in FIG. 3, the monitoring equipment 6 detects, in a step S1, quantities which are characteristic of the operating parameters of the continuous casting mold 1.

The quantities detected are automatically detected, metrologically, by the monitoring equipment 6, at least partially during the casting of the metal strand 2. For example, the volume flows V, or Va to Vb mentioned above, the entry temperatures T1 or T1*a* to T1*d* mentioned above, and the exit temperatures T2 or T2*a* to T2*d* mentioned above, are detected metrologically. In this process—regardless of the number of the sidewalls 3*a* to 3*d*—the volume flows Va to Vd, the entry temperatures T1*a* to T1*d* and the exit temperatures T2*a* to T2*d* are generally detected metrologically for each of the sidewalls 3*a* to 3*d* separately. Furthermore, the operating quantities for the vibration equipment 5, that is the vibration frequency f, the vibration amplitude h and the displacement forces F required to vibrate the continuous casting mold 1, are generally detected metrologically.

Other quantities could alternatively be detected metrologically or reported to the monitoring equipment 6 in some other way. Examples of such quantities are the material of the metal strand 2, the format of the metal strand 2, such as for example its width b and thickness d, a casting powder 9 used in casting the metal strand 2, a casting speed v and a cast surface 10, or more precisely its level P.

In a step S2, the monitoring equipment 6 determines, by reference to the detected quantities, operating parameters of the continuous casting mold 1. To some extent, the execution of step S2 is trivial, namely if the detected quantities directly represent operating parameters of the continuous casting mold 1. However, it is to some extent necessary, by reference to the detected quantities, to determine in a non-trivial way the operating parameters of the continuous casting mold 1. For example, the monitoring equipment 6 can, as part of step S2, determine a heat flow W from the (overall) volume flow V, the associated entry temperature T1 and the associated exit temperature T2. If the volume flows Va to Vd, the entry temperatures T1*a* to T1*d* and the exit temperatures T2*a* to T2*d* are detected separately for each of the sidewalls 3*a* to 3*d*, then of course, as part of step S2, an applicable heat flow Wa to Wd will be determined for each of the sidewalls 3*a* to 3*d* by reference to the corresponding values Va to Vd, T1*a* to T1*d*, T2*a* to T2*d*.

A further important operating parameter of the continuous casting mold 1, which must be determined in a non-trivial way, is a friction parameter R, which characterizes a level of friction arising between the metal strand 2 and the continuous casting mold 1. Insofar as it is determined, the friction parameter R is determined by the monitoring equipment 6 as part of step S2, by reference to the vibration frequency f, the vibration amplitude h and the displacement forces F.

In a step S3, the monitoring equipment 6 gives the operating parameters an associated timestamp and temporarily stores them away internally together with the timestamp. If necessary, the characteristic quantities underlying the operating parameters can also be stored away together with the operating parameters.

In a step S4, the monitoring equipment 6 forms groups G1, G2 of operating parameters. Each of the groups G1, G2 includes several operating parameters. In particular, each of them includes at least one basic operating parameter, and at least one supplementary operating parameter. For example, the monitoring equipment 6 can, as part of step S4, form a first group G1 of operating parameters. The first group G1 of operating parameters includes, as the supplementary operating parameter, the heat flow W, Wa to Wd and as the basic operating parameter the operating parameters which are relevant for the heat flow W, Wa to Wd. These operating parameters—i.e. the operating parameters which are relevant in the context of the first group G1—include in particular the format b, d of the metal strand 2 and the casting speed v, thus in sum the amount of the metal strand 2 which is cast per unit of time. Furthermore, they include the start temperature, at which the liquid metal is fed to the continuous casting mold 1, the physical parameters of the material of the metal strand 2, for example its specific setting point enthalpy and the level P of the surface of the cast 10. Other quantities can also be considered, such as for example the casting powder 9 which is used. On the other hand, the items of vibration data, f, h, F are generally of lower importance in the context of the first group G1. They can, but need not necessarily, be contained in the first group G1.

Alternatively or in addition to the first group G1, the monitoring equipment 6 can, as part of step S4, form a second group G2 of operating parameters. The second group G2 of operating parameters includes as the supplementary operating parameter the friction parameter R and as the basic operating parameter those operating parameters which are relevant to the friction parameter R. These operating parameters—i.e. the operating parameters which are relevant in the context of the second group G2—include in particular the start temperature, at which the liquid metal is fed to the continuous casting mold 1, the physical parameters of the material of the metal strand 2, the format b, d of the metal strand 2 and the casting powder 9 used and the surface 10 of the cast or its level P. Further operating parameters can also be contained in the second group G2.

It is possible that the operating parameters explained above are the only operating parameters which are utilized. However, it is alternatively possible to take into account further operating parameters. Examples of this type of operating parameter are the immersion depth of an immersion tube into the continuous casting mold 1 and/or parameters which characterize a shape of the vibration of the continuous casting mold 1 which deviates from a sinusoidal wave.

Other parameters are, for example, the measured values from temperature sensors which are built into the sidewalls 3*a* to 3*d* of the continuous casting mold 1. Other operating parameters are also possible. These operating parameters are generally basic operating parameters.

Furthermore, further groups of operating parameters can be formed as necessary.

In a step S5, the monitoring equipment 6 selects one of the groups G1, G2 which has been formed. In a step S6, the monitoring equipment 6 automatically determines the value of a logical variable OK. The logical variable OK takes the value WAHR (TRUE) if and only if the operating parameters of the selected group G1, G2 satisfy in each case a first stability criterion over a relevant evaluation time period. The evaluation time period can be the same for all the operating parameters in the selected group G1, G2. In general, however, within the selected group G1, G2 it is defined specifically for each particular operating parameter. For example, in the case of the heat flow W, Wa to Wd the range can lie within a single digit range of minutes. For this operating parameter it mostly lies between 1 min and 5 min. For other groups and/or other operating parameters, each evaluation time period can have a different value. For example, in the context of the second group G2 it can lie in the double-digit range of minutes for the friction value R operating parameter. In particular, it can lie between 20 min and 30 min. In contrast, the stability criteria for the operating parameters in the group G1, G2 can—depending on the situation in the individual case—either be all the same within the selected group G1, G2 or can vary. Examples of suitable stability criteria are,

- that within the relevant evaluation time period the difference between a minimum value and a maximum value of the operating parameter concerned lies beneath a prescribed absolute amount,
- that within the relevant evaluation time period, relating to the minimum value, to the maximum value or to the sum of the minimum value and the maximum value, the difference between a minimum value and a maximum value of the operating parameter concerned lies beneath a prescribed relative amount, or
- that within the relevant evaluation time period the operating parameter concerned fluctuates only within a prescribed absolute or relative amount about a statistical mean value of the operating parameter concerned.

Other stability criteria are also conceivable. In particular, before the actual stability criterion is applied, the relevant operating parameter can be subject to filtering—for example the formation of a moving average value over a relatively short period of time of a few seconds.

In a step S7, the monitoring equipment 6 checks the value of the logical variable OK. Depending on the result of this check, the monitoring equipment 6 carries out a step S8, or does not carry it out. If the monitoring equipment 6 carries out the step S8, it copies the operating parameters from the group selected in step S5 into a database 12, as a data record 11. The monitoring equipment 6 assigns to the corresponding data record 11 the basic operating parameters as input quantities and the supplementary operating parameters as output quantities.

In a step S9, the monitoring equipment 6 checks whether it has now carried out the steps S5 to S8 for all the groups G1, G2 formed in step S4. If not, the monitoring equipment 6 goes back to step S5. However, in carrying out again the step S5 it selects another group G1, G2 of operating parameters which have not so far been dealt with. Otherwise, the monitoring equipment 6 swaps over to a step S10.

In step S10, the monitoring equipment 6 selects some of the operating parameters which it determined in step S3. In particular, in step S10 the monitoring equipment 6 selects the basic operating parameters. On the other hand it specifically does not select the heat flow W, Wa to Wd and the friction parameter R.

In a step S11, the monitoring equipment 6 determines those data records for which the input quantities match the basic operating parameters. In a step S12, the control device 6 determines, by reference to these data records 11, permissible operating parameter ranges for the supplementary operating parameters, that is for the operating parameters which were not selected in step S10. For example, the relevant permissible operating parameter range can be determined by reference to a mean value of the relevant output quantities in the appropriate data records 11 and a statistical standard deviation for the data records 11 evaluated in step S11.

In a step S13, the monitoring equipment 6 automatically determines the value of the logical variable OK once again. In the context of step S13, the logical variable OK takes the value WAHR (TRUE) if and only if the supplementary operating parameters lie within the permissible operating parameter ranges determined in step S11.

In a step S14, the monitoring equipment 6 checks the value of the logical variable OK. Depending on the result of the check, the monitoring equipment 6 carries out either a step S15 or a step S16. In step S15, no special measures are initiated. In the step S16 on the other hand, the monitoring equipment 6 initiates further measures. For example, in the step S16 the monitoring equipment 6 can trigger the output of a warning message to an operator 13 (see FIG. 1) of the continuous casting mold 1. This warning message can be, in particular, an acoustic and/or an optical warning signal, for example a hooting sound or a flashing light. Thus, for example, a dynamic optical warning signal can be triggered, for example a flashing light. Alternatively or additionally, the monitoring equipment 6 can include with the output a note of which supplementary operating parameter lies outside its permissible range and how a return to within the appropriate permissible range can be effected. For example, if the heat flow W, Wa to Wd becomes too great, the output can include a message that the casting speed v should be reduced. It is also possible, if the friction parameter R is too small or too large, to output a note that the casting powder 9 should be changed and/or slag which has formed on the surface 10 of the casting should be removed.

It is even possible that the monitoring equipment 6 itself carries out an adjustment intervention directly, by means of which (at least) one basic operating parameter of the continuous casting mold 1 is altered. For example, the monitoring equipment 6 can be identical with a control device for the continuous casting mold 1 and can adjust the casting speed v appropriately. It is also possible that the monitoring equipment 6 is indeed a different device from the control device for the continuous casting mold 1, but can in an emergency situation intervene directly in the control of the continuous casting mold 1 or can communicate to the control device for the continuous casting mold 1 an appropriate message.

Figure 4:
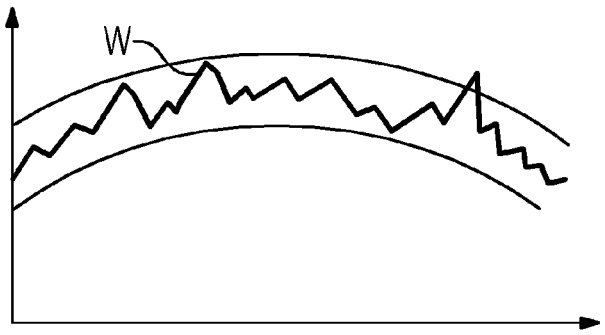
FIG. 4 shows a timing diagram.

Furthermore, the monitoring equipment 6 can in a step S17 output to the operator 13 on a display a graph against time for the past up to the current time of, for example, (at least) one operating parameter—in particular of one of the supplementary operating parameters, for example the heat flow W—and in the display include, in addition to the operating parameter which is output, its permissible range. FIG. 4 shows an example of a display of this type.

The steps S4 to S9, on the one hand, and steps S10 to S16 on the other, are executed independently of each other. It is also possible, as an alternative to what FIG. 3 shows, to execute steps S10 to S16 before steps S4 to S9, or steps S4 to S9 and steps S10 to S16 in parallel.

Steps S1 to S17 are executed repeatedly by the monitoring equipment 6 with a relatively short cycle time of, for example, 0.1 s. It is possible to perform the checks in steps S6 and S7 in each cycle, and if step S8 is performed, to write the corresponding operating parameters into the database 12 as a data record 11. In this case, the repetition time for the performance of the first check, and for the copying which is based on it of a data record 11 into the database 12, is a repetition time which is identical with the cycle time. Alternatively, it is possible, after each writing of a new data record 11 into the database 12, to insert an enforced pause, within which no further data records 11 are copied into the database 12. For the purpose of realizing the enforced pause, use can be made, for example, of a timer. Alternatively, the enforced pause can be realized by skipping the steps S5 to S8, or only step S8. In this case, the repetition time with which the first check, and the copying which is based on it of a data record 11 into the database 12, corresponds to the enforced pause.

The repetition time will preferably be substantially shorter than the evaluation period for the at least one supplementary operating parameter in the group G1, G2 concerned. For example, the repetition time can lie at 0.1 s, at 1 s, at 10 s or at 30 s. In the case of a corresponding evaluation time period in the upper single-digit minute range, the repetition time can also lie in the lower single-digit range. In the case of a corresponding evaluation time period in the double-digit minute range the repetition time can also lie in the lower or in the upper single-digit minute range, or anywhere in the single-digit minute range. It is generally true that the value of the repetition time should be at most 0.2 times, and better at most 0.1 times or 0.05 times the corresponding evaluation time period. However, it is in principle also possible that the repetition time is identical with the evaluation time period.

The approach explained above ensures that only data records 11 are copied into the database 12 for which the casting process as such is running in a stable manner. It is however possible that, in spite of a stable casting process, the metal strand 2 does not have the desired product characteristics. In this case, it is not sensible to operate the casting process using the operating parameters defined by the data record 11 concerned. Preferably therefore a step S21 will be arranged before the step S8—see FIG. 5. In step S21, the monitoring equipment 6 checks whether a blocking command B has been issued to it by the operator 13 (see FIG. 1). If the operator 13 does issue the blocking command B, the monitoring equipment 6 skips over step S8, in which the data record 11 concerned is copied into the database 12. Thus, in this case, the monitoring equipment 6 suppresses the copying into the database 12 of the data record 11 concerned.

Figure 5:
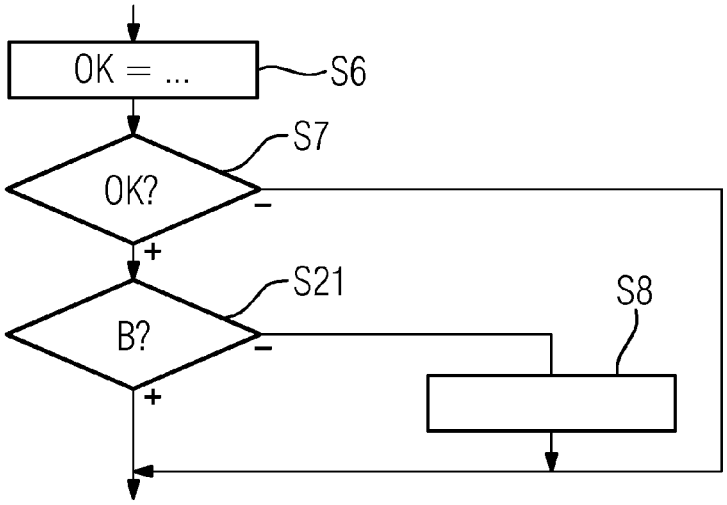
FIGS. 5 to 7 show flow diagrams.

Alternatively or in addition to the approach FIG. 5, it is possible that the monitoring equipment 6 implements, in addition to the approach explained in conjunction with FIG. 3, processing by the operator 13 of the data records 11 held in the database 12. This will be explained below in more detail in conjunction with FIG. 6.

Figure 6:
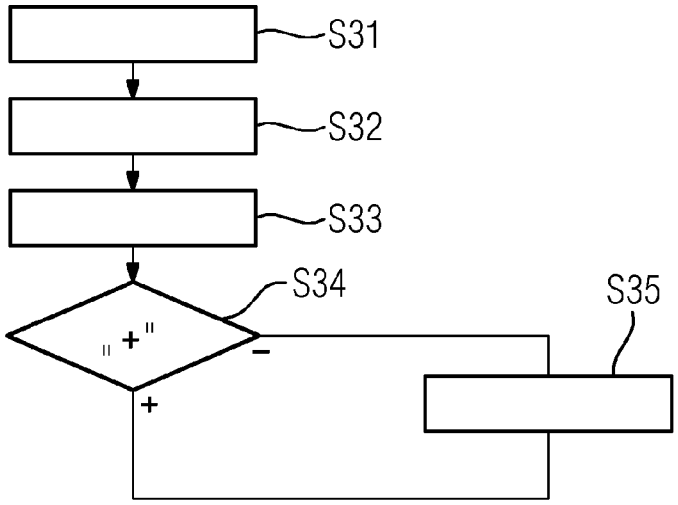

As shown in FIG. 6, in a step S31 the monitoring equipment 6 accepts from the operator 13 a selection command for (at least) one data record 11 which is held in the database 12. In a step S32, the monitoring equipment 6 outputs the selected data record 11 to the operator 13. In a step S33, the monitoring equipment 6 accepts from the operator 13 an assessment of the displayed data record 11. This assessment may either be a positive or a negative assessment. In a step S34, the monitoring equipment checks the assessment. In the case of a positive assessment, no further measures are initiated. In the case of a negative assessment, in a step S35 the monitoring equipment 6 removes from the database 12 the data record 11 which was selected in step S31. The approach shown in FIG. 6 can be carried out as often as necessary.

The copying of the data records 11 into the database 12 can—provided that the appropriate stability criteria are satisfied—always take place. The determination of the permissible operating parameter ranges will preferably only take place if the data records 11 held in the database 12 satisfy a completeness criterion. This is explained in more detail below in conjunction with FIG. 7.

Figure 7:
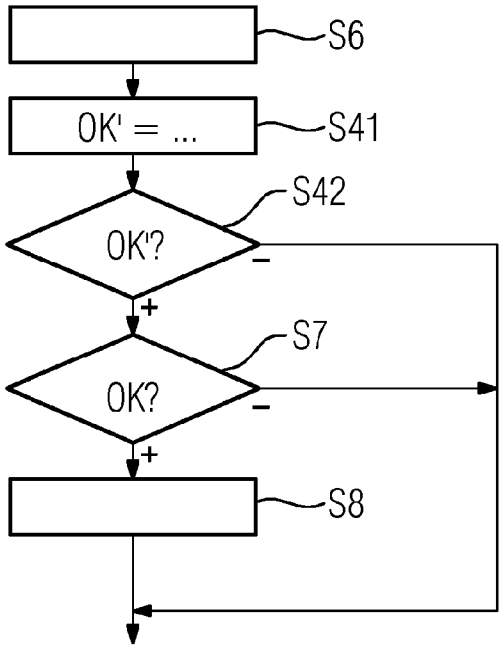

As shown in FIG. 7, the steps S41 and S42 are arranged before the step S11. In step S41, the monitoring equipment 6 automatically determines the value of a further logical variable OK'. The logical variable OK' takes the value WAHR (TRUE) if and only if the data records 11 contained in the database 12 satisfy a completeness criterion. For example, the monitoring equipment 6 can check, as part of step S41, whether the database 12 contains an adequate number of data records 11 for the input quantities selected as part of step S10, that is the number of appropriate data records 11 stored in the database 12 exceeds a predefined threshold value. Alternatively or additionally, the monitoring equipment 6 can check, as part of step S41, whether the output quantities for the data records 11, that is the supplementary operating parameters, satisfy a second stability criterion. The application of the second stability criterion is analogous to that of the first stability criterion. It is also possible that the monitoring equipment 6 checks as part of step S41, whether

- the number of appropriate data records 11 stored in the database 12 exceeds a predefined first threshold value and/or
- the number of appropriate data records 11 stored in the database 12 exceeds a predefined second threshold value and in addition the supplementary operating parameters for the corresponding data records 11 satisfy the second stability criterion.

The first threshold value is in this case larger than the second threshold value.

In step S42, the monitoring equipment 6 checks the value of the logical variable OK. Depending on the result of this check, the monitoring equipment 6 will either perform step S11 and the steps S12 to S15 which build on step S11, or will not perform it.

Figure 8:
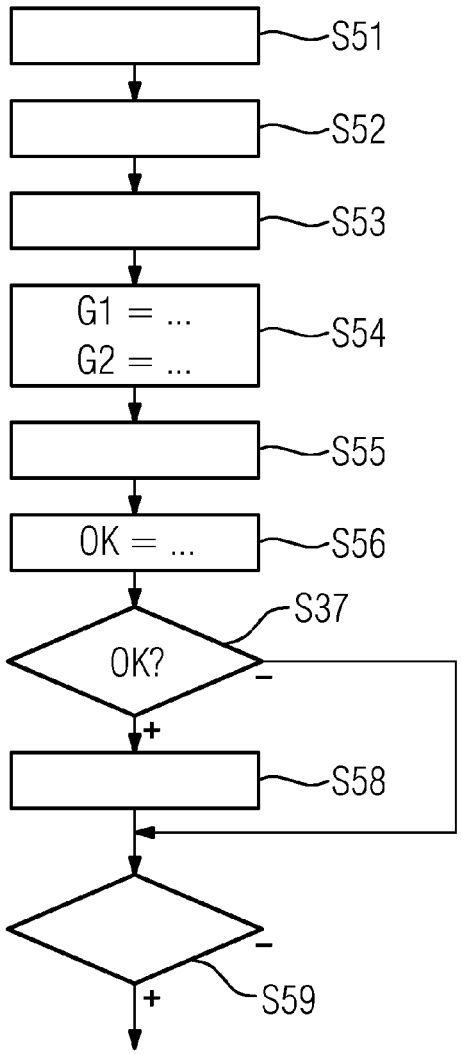
FIG. 8 is a modified flow diagram of FIG. 3.

Insofar as already explained, the monitoring equipment 6 builds up the database 12 as such by reference exclusively to the operating data for the continuous casting mold 1 which it monitors. This is obviously possible, but does have the result that at the start of the operation of the continuous casting mold 1 the database 12 either does not yet contain any data records 11, or only a few. So the monitoring equipment 6 will thus preferably—see FIG. 1—provide a data input 14. Through this data input 14, the monitoring equipment 6 can, in a step S51 as shown in FIG. 8, accept time sequences of characteristic quantities. The sequences accepted are not characteristic quantities which are directly characteristic of the operating parameters of the continuous casting mold 1. So they are not quantities which have arisen in ongoing operation of the continuous casting mold 1, but are other quantities. The characteristic quantities accepted through the data input 14 could be, for example, older operating data for the continuous casting mold 1, stored in some other way, or operating data from another continuous casting mold or operating data determined in some other way. Regardless of what the data is, each data item is in any case given a timestamp.

In relation to the characteristic quantities accepted in step S51, the monitoring equipment 6 performs steps S52 to S59. In content, the steps S52 to S59 correspond with the steps S2 to S9 in FIG. 3. On the other hand, in relation to this data the monitoring equipment 6 does not perform any steps corresponding to the steps S10 to S15 in FIG. 3.

The present invention has many advantages. Thus, it ensures for example that the database 12 is filled fully automatically with data records 11 which specify stable, and hence permissible, casting conditions. This also makes it possible, in the case of new materials—for example in the case of new types of steel—to specify permissible operating parameters very rapidly to the operator 13 in a reliable way. The possibility of defining data records 11 in a different way—i.e. separately from the current operation of the continuous casting mold 1—speeds up the building up of the database 12. The possibility for suppressing the copying of data records 11 into the database 12, or for deleting again data records 11 which have already been copied in, improves the reliability of the database 12. Furthermore, a reliable value range within which he can work without problems is indicated to the operator 13.

Although the invention has been illustrated and explained in detail by the preferred exemplary embodiment, the invention is not restricted to the examples disclosed, and other variations can be derived herefrom by the person skilled in the art without departing from the scope of protection of the invention.

LIST OF REFERENCE MARKS

1 Continuous casting mold
2 Metal strand
3*a* to 3*d* Sidewalls
4 Coolant
5 Vibration equipment
6 Monitoring equipment
7 Computer program

8 Machine code
9 Casting powder
10 Surface of cast
11 Data records
12 Database
13 Operator
14 Data input
b Width
B Blocking command
d Thickness
f Vibration frequency
F Displacement forces
G1, G2 Groups
h Vibration amplitude
OK, OK' Logical variables
P Level
R Friction parameter
S1 to S59 Steps
T1, T1*a* to T1*d* Entry temperatures
T2, T2*a* to T2*d* Exit temperatures
v Casting speed
V, Va to Vd Volume flows
W, Wa to Wd Heat flows

The invention claimed is:

1. A method of monitoring for a continuous casting mold for casting a metal strand using monitoring equipment which performs the steps of:

detecting quantities;

automatically detecting metrologically at least some of the quantities during the casting of the metal strand;

determining and temporarily storing operating parameters of the continuous casting mold by reference to the quantities detected;

forming groups of operating parameters from the operating parameters, wherein each group of operating parameters in the groups of operating parameters includes at least one basic operating parameter and at least one respective supplementary operating parameter;

automatically copying the operating parameters of each group of operating parameters into a database as a data record if the operating parameters of the group that are to be copied into the database are within a predetermined range over a relevant evaluation time period;

assigning each of the at least one basic operating parameters of the groups of operating parameters as an input quantity, and a respective one of the at least one supplementary operating parameters of the groups of operating parameters as an output quantity for each of the at least one basic operating parameters;

selecting at least one temporarily stored basic operating parameter;

determining the data records held in the database with the input quantities that match the at least one selected temporarily stored basic operating parameter, and using the determined data records, determining permissible operating parameter ranges for the at least one supplementary operating parameters of the groups of operating parameters; and issuing to an operator of the continuous casting mold a warning message, and/or outputting a note as to which of the at least one supplementary operating parameters of the groups of operating parameters lies outside its respective permissible operating parameter range, and how the supplementary operating parameter that is outside its respective permissible operating parameter range can be brought back into its respective permissible operating parameter range, and/or immediately executing a corrective intervention by means of which a basic operating parameter of the continuous casting mold is altered, or communicating an applicable report to a control device for the continuous casting mold if the at least one supplementary operating parameters of the groups of operating parameters lie outside their permissible ranges.

2. The method of monitoring as claimed in claim 1, further comprising:

cooling the continuous casting mold by a volume flow of a liquid coolant into and out of the mold, wherein when the coolant enters the continuous casting mold, the liquid coolant has an entry temperature and on emerging from the continuous casting mold has an exit temperature;

metrologically detecting during the casting of the metal strand the quantities which include the volume flow, the entry temperature and the exit temperature; and also detecting the operating parameters including a heat flow determined from the volume flow, the entry temperature and the exit temperature.

3. The method of monitoring as claimed in claim 2, wherein the continuous casting mold has a plurality of sidewalls, and the method further comprises:

detecting the volume flow, the entry temperature and the exit temperature separately for each of the sidewalls; and determining the heat flow separately for each of the sidewalls.

4. The method of monitoring as claimed in claim 2, wherein the at least one supplementary parameter in one of the groups of operating parameters is the heat flow and each operating parameter relevant for the heat flow is the at least one basic operating parameter, the operating parameters relevant to the heat flow being the volume flow, the entry temperature, and the exit temperature.

5. The method of monitoring as claimed in claim 1, further comprising:

vibrating the continuous casting mold during the casting of the strand by a vibration mechanism with a vibration frequency a vibration amplitude, metrologically detecting during the casting of the metal strand the quantities which include the vibration frequency, the vibration amplitude and the displacement forces required to vibrate the continuous casting mold; and determining the operating parameters including a friction parameter from the vibration frequency, the vibration amplitude and the displacement forces for friction arising between the metal strand and the continuous casting mold.

6. The method of monitoring as claimed in claim 5, wherein the at least one supplementary operating parameter of one of the groups of operating parameters is the friction, and each operating parameter relevant to the friction is the at least one basic operating parameter, the operating parameters relevant to the friction being the vibration frequency, the vibration amplitude, and the displacement forces for friction arising between the metal strand and the continuous casting mold.

7. The method of monitoring as claimed in claim 1, wherein the at least one basic operating parameter is one of a material of the metal strand, a format of the metal strand, a casting powder used in the casting of the metal strand, a casting speed, and a level of the surface of the cast material.

8. The method of monitoring as claimed in claim 1, further comprising:

the monitoring equipment performing the further steps of:

accepting, through a data input, time sequences of quantities in addition to the detected quantities;

forming reference groups of operating parameters by reference to the accepted quantities, the operating parameters in each reference group including at least one reference basic operating parameter and at least one reference supplementary operating parameter;

copying into the database, as reference data records, operating parameters of reference groups that are within a predefined range over a relevant evaluation time period; and assigning to each data record a respective basic operating parameter from a respective reference group, as an input quantity, and a respective supplementary operating parameter from a respective reference group as an output quantity.

9. The method of monitoring as claimed in claim 8, further comprising:

the monitoring equipment suppressing the copying of the data records into the database if an operator of the continuous casting mold issues a blocking command to it, or removes data records which have already been copied into the database from the database again if the operator issues a negative assessment of the data record.

10. The method of monitoring as claimed in claim 1, further comprising:

determining the permissible operating parameter ranges for the at least one supplementary operating parameters of the groups of operating parameters if and only if a number of data records in the database with assigned input quantities exceed a predefined value.

11. The method of monitoring as claimed in claim 1, wherein the automatically copying is performed cyclically at regular time intervals, the time intervals being shorter than the evaluation time period.

12. A computer program which incorporates machine code, and which is directly executed by monitoring equipment used for a continuous casting mold and the execution of the program by the monitoring equipment has the effect that the monitoring equipment carries out a monitoring method with all the steps of a monitoring method as claimed in claim 1.

* * * * *